US007178296B2

(12) United States Patent
Houghton

(10) Patent No.: US 7,178,296 B2
(45) Date of Patent: Feb. 20, 2007

(54) STRUCTURAL JOINT CONNECTION PROVIDING BLAST RESISTANCE AND A BEAM-TO-BEAM CONNECTION RESISTANT TO MOMENTS, TENSION AND TORSION ACROSS A COLUMN

(76) Inventor: David L. Houghton, 6222 Rosemary Dr., Cypress, CA (US) 90630

( * ) Notice: Subject to any disclaimer, the term of this patent is extended or adjusted under 35 U.S.C. 154(b) by 343 days.

(21) Appl. No.: 10/805,448

(22) Filed: Mar. 19, 2004

(65) Prior Publication Data

US 2005/0204684 A1 Sep. 22, 2005

(51) Int. Cl.
*E04C 2/38* (2006.01)

(52) U.S. Cl. ..... 52/261; 52/656.9; 52/737.1; 52/167.3; 52/655.1

(58) Field of Classification Search ..... 52/653.1, 52/655.1, 656.9, 737.1, 236.3, 167.3
See application file for complete search history.

(56) References Cited

U.S. PATENT DOCUMENTS 1,883,376 A * 10/1932 Hilpert et al. ..... 52/654.1
2,943,716 A * 7/1960 Babcock ..... 52/653.1
3,722,169 A 3/1973 Boehmig
3,952,472 A * 4/1976 Boehmig ..... 52/655.1
5,402,614 A * 4/1995 Jewell ..... 52/299
5,660,017 A * 8/1997 Houghton ..... 52/655.1
5,680,738 A * 10/1997 Allen et al. ..... 52/729.1
6,138,427 A * 10/2000 Houghton ..... 52/655.1
6,237,303 B1 * 5/2001 Allen et al. ..... 52/729.1
6,516,583 B1 * 2/2003 Houghton ..... 52/655.1

(Continued)

OTHER PUBLICATIONS

A U. S. Government publication, Department of Defense, Appendix K DOD Interim Antiterrorism Force Protection Construction Standards, Progressive Collapse Design Guidance, N62742-98-4-1353, Amendment No. 0007, dated Apr. 4, 2000. Copy, two pages, attached. The relevant portion is the second page which is discussed above.

(Continued)

*Primary Examiner*—Richard E. Chilcot, Jr.
*Assistant Examiner*—Lindsay M. Maguire
(74) *Attorney, Agent, or Firm*—L. Lee Humphries

(57) ABSTRACT

At a beams-to-column connection of two beams to a column, in which the joint connection comprises both a gravity load-carrying capability and a moment-resisting capability between each beam and column, there is added a beam-to-beam connection across the column, using two gusset plates, facing each other on opposite sides of the joint connection. The gusset plates which are not welded directly to the column in a moment-resisting connection, connect the two beams in a tension, shear and moment-resisting connection with respect to each other. Such beam-to-beam connection by the gusset plates provides the capability of withstanding severe torsional and lateral inelastic deformation due to direct blast pressure. When subjected to violent conditions and upon loss of column support or the loss of integrity of the beams-to-column joint connection, the two beams and gusset plates provide independent beam-to-beam structural continuity, causing the two beams to act as one long beam.

22 Claims, 7 Drawing Sheets

U.S. PATENT DOCUMENTS

| | | | | |
|---|---|---|---|---|
| 6,591,573 | B2 * | 7/2003 | Houghton | 52/656.9 |
| 6,802,169 | B2 * | 10/2004 | Simmons | 52/648.1 |
| 2002/0124520 | A1 * | 9/2002 | Bock et al. | 52/655.1 |
| 2003/0208985 | A1 * | 11/2003 | Allen et al. | 52/653.1 |

OTHER PUBLICATIONS

A U. S. Government publication, Department of Defense, Unified Facilities Criteria (UFC) DoD Minimum Antiterrorism Standards For Buildings, date Jul. 31, 2002, UFC-4-010-01. Copy attached. The relevant portions are discussed above.

(A U.S. Government publication) General Services Administration, GSA, Progressive Collapse Analysis and Design Guidelines for New Federal Office Buildings and Major modernization Projects, Jun. 2003. Copy attached. The relevant portions are discussed above and more particularly, Appendix D, Structural Steel Connections.

* cited by examiner

STRUCTURAL JOINT CONNECTION PROVIDING BLAST RESISTANCE AND A BEAM-TO-BEAM CONNECTION RESISTANT TO MOMENTS, TENSION AND TORSION ACROSS A COLUMN

BACKGROUND OF THE INVENTION

Buildings, towers and similarly heavy structures commonly are built on and around a steel framework. A primary element of the steel framework is the joint connection of the beams to the column. Gusset plates have been used to provide a superior beams-to-column, moment-resisting joint connection, as set forth in my related U.S. Pat. No. 5,660,017 entitled Steel Moment Resisting Frame Beam-to-Column Connections. A brace, which further strengthened the steel framework, was later added to that joint connection by connecting a brace or braces to the gusset plates, as set forth in my U.S. Pat. No. 6,516,583, entitled Gusset Plate Connections for Structural Braced Systems. Additional, related patents issued to me are U.S. Pat. No. 6,138,427 for Moment Resisting, Beam-to-Column Connection and U.S. Pat. No. 6,591,573 for Gusset Plates Connection of Beam-to-column.

The above patents teach placing a pair of gusset plates opposite each other, on opposite sides of a column, with the gusset plates extending outwardly from the column along the sides of a beam, to provide a means for connecting the beam to the column, except my U.S. Pat. No. 6,591,573, which does not use gusset plates extending across a column and, is, therefore, excluded as one of "my related patents", hereinafter. Of course, as taught in my U.S. Pat. No. 5,660,017 and my related patents, the gusset plates may extend in both directions from a column, that is, they may extend across a column, and connect two beams to one column, one beam on each side of the column. Such patents also teach gusset plates, welded to the column along the vertical flange edges of the column, and those gusset plates also, are welded to the beam along the horizontal flange edges of the beam, in the longitudinal direction of the beam, or, alternatively, if the beam's flanges are not as wide as the column, and, so, the beam's flanges do not span the width between the gusset plates, sufficiently wide cover plates are attached to the flanges of the beam, and the gusset plates are welded to the longitudinal edges of such cover plates, in the longitudinal direction of the beam. Thus, a longitudinal weld connection lies along the gusset plates in the longitudinal direction of the beam. The gusset plates are thus fixedly attached with respect to the beam.

Fillet welds are preferably used both in attaching the gusset plates to the vertical flange edges of the column and in the longitudinal welds attaching the gusset plates to the beam or, alternatively, to cover plates attached to the beam.

The teachings of those patents are incorporated herein by this reference, particularly U.S. Pat. No. 5,660,017 which teaches the original concept of using gusset plates to provide great overall strength and ductility in beams-to-column joint connections and in beam-to-beam connections across a column. Such a gusset plates connection from beam-to-beam remains effective across a damaged column, even if the column provides no support, and also, remains effective across a compromised beam-to-column-to-beam joint connection. As explained hereafter, the gusset plates beam-to-beam connection, of the invention herein, also remains effective under such circumstances.

The gusset plate inventions described in the above-mentioned patents were occasioned by the poor performance of the "traditional", prior fabrication of beam-to-column joint connections, wherein, customarily, the beam was connected to a column by welding the ends of the beam flanges to the column flange, (column face), using full penetration, single bevel groove welds to obtain a moment-resisting connection. When such prior connections were loaded by severe moments and loads such as those caused by earthquakes, explosions and other disasters, they failed. The Northridge earthquake in California in 1994 demonstrated that such prior joint connections were unsuitable for resisting or carrying, (transferring), moments and loads caused by earthquakes. Therefore, such "traditional joint connections" were also unsuitable in the event of explosions, tornadoes and other disastrous events. Under severe load and moment conditions, occasioned by such a disastrous event, the forces and loads of the event would cause the "traditional joint connection" to fail. There occurred one or more of, fracture of the welds, fracture of the metal of the beam or of the column, or the beam pulled divots out of the flange, (face), of the column.

There was insufficient strength, insufficient resistance to moments and insufficient ductility in the prior joint connections. Prior construction had little or no continued strength beyond the yield point of the joint connections.

Over the last several years, there has been considerable additional concern as to how to improve the beams-to-column joint connections so they will withstand explosions, blasts and the like as well as other related load phenomena. Of particular concern is the prevention of progressive collapse of the building if there are one or more column failures due to terrorist bomb blast, vehicular and/or debris impact, structural fire attack or any other impact and/or heat-induced damaging condition.

Column failures due to explosions, severe impact and/or sustained fire, have led to progressive collapse of entire buildings. An example of such progressive collapse occurred in the bombing of the A. P. Murrah Federal Building in Oklahoma City in 1995 and the aerial attack of the World Trade Center towers in 2001.

It is to be appreciated that U.S. Pat. No. 5,660,017 teaches that gusset plates may be used to attach beams, on both sides of a column, to the column. In other words, a single pair of gusset plates may extend across the column and along each beam on opposite sides of the column. Not only are the beams strongly connected to the column by the gusset plates, but, the beams are also strongly connected to each other by the gusset plates.

Following the 1994, California earthquake, in addition to my invention set forth in U.S. Pat. No. 5,660,017, a number of other alternatives, to resist joint connection failure, were adopted for use in steel construction design for improved seismic performance; for example, the reduced beam section, (RBS), or "dogbone" joint connection, in which the beam flanges are narrowed near the joint connection. This alternative design reduces the plastic moment capacity of the beam allowing inelastic hinge formation of the beam to occur at the reduced section of the beam, in order to relieve some of the stress in the joint connection between the beam and the column. U.S. Pat. No. 5,595,040, issued Jan. 21, 1997, for Beam-to-Column Connection to Sheng-Jin Chen, illustrates such "dogbone" connections. It works. Nevertheless, inasmuch as the plastic moment capacity of the beam is reduced, because of the narrowing of the beam flanges, the moment load which can be withstood by the beam is substantially reduced.

Another alternative is illustrated by U.S. Pat. No. 6,237,303, issued May 29, 2001, to Clayton Jay Allen et al., in which slots and holes are used in the web of one or both of the column and the beam, in the vicinity of the joint connection, to provide improved stress and strain distribution in the vicinity of the joint connection.

Other post-Northridge joint connections are also identified in FEMA 350-Recommended Seismic Design Criteria for New Steel Moment Frame Building, published by the Federal Emergency Management Agency in 2000. All such post-Northridge joint connections have reportedly demonstrated their ability to achieve the required inelastic rotational capacity to survive a severe earthquake or other disastrous event.

None of these alternative joint connections, however, provide independent beam-to-beam structural continuity across the column; such continuity being capable of independently carrying gravity loads under a "double-span" condition resulting from a column violently removed by, say, explosion, blast, impact or other means, regardless of the damaged condition of the column. Indeed, there are no additional load paths across the column in the event of column failure or joint connection failure or both. Nor do any of these alternatives, except my gusset plates used as taught in U.S. Pat. No. 5,660,017 and my related patents listed above, and the gusset plates used as taught in the invention herein provide any significant torsional capacity or significant resistance to lateral bending to resist direct air blast impingement and severe impact loads. Torsional demands are created because the top flange of the beams is typically rigidly attached to the floor system of a building laterally, thereby leaving the bottom flange of the beam free to twist when subjected to, say, direct lateral air blast impingement caused by a terrorist attack.

Nor do the alternative joint connections provide any reserve capacity for resisting inelastic axial tension load demands imposed by the beams in a "double-span" condition following the removal or impairment of a column or loss or impairment of beam-to-column joint connections, notwithstanding the alternative joint connections rated inelastic rotational capacity.

These collective attributes do not exist in prior art beam-to-column joint connections.

All of the aforementioned missing attributes, if included, would clearly mitigate the likelihood of progressive collapse of steel frame buildings and would provide blast hardening of beams-to-column joint connections against terrorist attack.

All of these post-Northridge alternative joint connections and pre-Northridge joint connections, (except those of my U.S. Pat. No. 5,660,017 and my related patents), may be classified as "traditional joint connections" because they rely on direct welding of the beam flanges or a beam's cover plates, to the face of the column flange. Thus, the "traditional joint connections" cannot maintain beam-to-beam continuity across a blast-damaged, or otherwise failed, column, because such continuity necessarily depends on maintaining the structural integrity of that very same column and the joint connections thereto. Therefore, such beam-to-beam continuity is lost when the column has been either altogether removed or, as a minimum, the column or the joint connections thereto, have been severely damaged and structurally compromised.

Nor can such "traditional joint connections" maintain their rated inelastic rotational capacity upon a blast and its resulting effects or similar damaging effects, because the "traditional joint connections" provide no protection of the joint connection as provided herein by the robust capacity of the gusset plates.

Simply put, the gusset plates of the present invention also provide a shield for the joint connection against blasts and its effects. Such feature is also found in my U.S. Pat. No. 5,660,017 and my related patents.

The "traditional joint connections" are fundamentally not able to satisfy the performance expectations for credible mitigation of blast effects. Also, in such connections, an essential, suitable, beam-to-beam structural linkage across a blast-failed column and/or its beam-to-column joint connections, if impaired or lost, simply does not exist.

SUMMARY OF INVENTION

This invention is a structural joint connection comprised of two beams which extend from opposite sides of a column and which beams are each connected to the column in a gravity load-bearing connection and the beams are additionally each connected to the column in at least a vertical moment-resisting connection. Such vertical moments are about the major, (strong), axis of the beam. This invention adds to such joint connection an independent, beam-to-beam connection across the column, using two gusset plates, connecting the two beams together in a robust connection which is very strong, ductile, and resilient."

It is recognized that upon blast or explosion or other disastrous event, support from the column may be partially or totally lost. This may be due to loss of the column and/or partial or total failure of the beams-to-column joint connections. In either event, the beams-to-column joint connection is then insufficient and unreliable.

Given the violent removal, during a terrorist attack, for example, of a column positioned between two adjacent beams, the strength of this invention's beam-to-beam gusset plates connection across that column, independent of that column's demise or damaged state, is capable of resisting the ultimate tensile and flexural strength demands, including their interactive effects, from the beams joined by the gusset plates, which beams thereby remain joined and effective. Such extreme tension and moment demands result from the creation of, and gravity loading of, a "double-span" condition of the said two joined beams located on either side of the removed or damaged column, which "double-span" condition, in turn, exerts tremendous tensile pull and vertical moment demand on adjacent beams-to-column joint connections.

In applying the gusset plates to a beams-to-column joint connection in accordance with this invention, there should be an inspection and analysis of the gravity load-carrying capacity and the structural tensile and moment capacities of the beams-to-column joint connections, possibly, throughout the entire building or structure, (since it cannot be predicted which column support may be lost). In particular, the gravity load-carrying connections, (commonly, vertical shear tabs), at the outer ends of the beams, that might become part of the "double-span" beams condition, should be carefully assessed as to their load-carrying capabilities. It may well be necessary to replace or otherwise significantly strengthen any vertical shear tab connections, (or such other gravity load-carrying connection as may be used), between beam webs and columns, whether the beam is connected through such connection to the column face or to the column web. It may also be necessary, or desirable to provide cover plates, (or new cover plates in the case of strengthening existing structures), attached to the beams and welded to the column, in order to increase the tensile capacity, vertical moment capacity and the gravity load-carrying capacity of several, or even, all of the beams-to-column joint connections. Thus, the axial tensile capacity of the gravity load-carrying connection and the axial tensile capacity of any other beams-to-column joint connection, such as, for example, the vertical moment-resisting connection, should be collectively strong enough, or else made strong enough, to develop an axial tension substantially equal to the tensile capacity of the beams.

"Substantially equal", in the immediately previous case, means a range of slightly less to slightly more than.

"Substantially equal" has the same meaning when used in conjunction with other capacities herein.

In some cases, the gusset plates may need to be attached, preferably welded, to, say, horizontal continuity plates, welded within a column, as taught herein, so that the beams-to-column connections at adjacent columns are supplemented in strength by the added capability provided by said gusset plates attachment, at an adjacent column, to transfer the added axial tension loads to those adjacent columns, in the event of a disaster. It is recognized that continuity plates, when welded between the russet plates and the column, do provide a certain amount of moment resistance between the russet plates and the column. However, in this invention, moment resistance of the continuity plates is not their primary purpose (which, for Applicant in this invention, is increasing axial tension strength in an adjacent column, to meet failure of the other column or its beams-to-column joint connections), nor is it the same purpose as in the prior art, to strengthen the column and strengthen the connection from one beam on one side of the column to the other beam on the other side of the column.

When subjected to lateral blast loads with the column still in place between two adjacent beams, the strength and blast-hardening effects of this invention's robust beam-to-beam gusset plates connection, across that column, greatly increase the protection and likelihood of preserving the integrity of the rated inelastic rotational moment capacity of a "traditional" beam-to-column moment connection about the major axis of the beam caused by vertically applied loads. The present invention also provides both significant end-of-beam torsional and lateral flexural resistance about the minor axis of the beam caused by laterally applied air blast and impactive loads.

In the present invention, independently of such gravity load-bearing connections and moment-resisting beams-to-column joint connections, the two gusset plates are disposed on opposite sides of the beam-to-column joint connections and are connected to both of the beams and thus connect them together. The beam-to-beam connection provided by the gusset plates is sufficiently strong to greatly mitigate the damage from blasts, explosions, earthquakes, tornadoes and other violent disasters.

The beams may be co-linear, somewhat angled with respect to each other, or even curved, as in the practice in constructing a curved facade for buildings.

My U.S. Pat. No. 5,660,017 also teaches using two gusset plates to connect together two beams on opposite sides of a column, however, in my patent, the gusset plates are welded to the column, thus providing a moment-resisting connection directly between the gusset plates and the column. In distinction from the teachings of my patent, in the present invention, the gusset plates are not welded to the column. Nor are they fastened to the column in any direct, moment-resisting connection.

In the present invention, as stated above, the gusset plates cover and protect the beam-to-column joint connections which attach the two beams to the column, but, again, the gusset plates, themselves, are not directly welded or fastened to the column in any "substantial moment-resisting connection". By "substantial moment-resisting connection" is meant a "moment-resisting connection" which is capable of resisting, carrying, or transferring, severe moment loads substantially equal to the ultimate moment capacity of the beams, such as occasioned by explosions, blasts, earthquakes, tornadoes, high winds or other disasters.

Thus, the gusset plates do not themselves "directly transfer substantial moment loads" to the column. Rather, the gusset plates connect one beam to the other and transfer their loads, including their moment loads, axial tension loads and other loads, from beam-to-beam, instead of to the column.

The present invention may be used in conjunction with beams-to-column joint connections within a building or other structure, or applied to outer beams-to-column joint connections, as shown herein. The corner columns and, possibly, additional selected columns within the structure, may utilize the gusset plates connection taught in my U.S. Pat. No. 5,660,017, in which the gusset plates are not only welded to the beams (or cover plates on the beams, as the case may be), but, the gusset plates are also, welded directly, in a vertical direction, to the vertical edges of the column, by fillet welds, thus, creating, through the gusset plates, substantial moment-resisting connections.

The invention herein would not be used as a structural joint connection to the columns at the corners of a structure. At that corner location, there are not two beams, extending in generally, or approximately, opposite directions from the column. Such beams at the corners of a structure are not connected to each other by the gusset plates as taught herein. Rather, my invention taught in U.S. Pat. No. 5,660,017 would be most useful in making gusset plate connections at the corners of a structure.

Gusset plates, connected as taught by this invention, can be used on substantially any of the "traditional joint connections" or most any other suitably-designed beams-to-column joint connections which are designed to transfer the gravity load on the beams to the column and which, additionally, provide vertical moment-resistance between the beams and the column. Vertical moment resistance is moment resistance about the major axis of the beam.

The original beams-to-column joint connection, (and any desired strengthening thereof), must be capable of the resisting vertical moments substantially equal to the ultimate vertical moment capacity of the beam. Upon loss of a column, or the support it provides, the joint connection of each beam to the column must also be capable of carrying significant axial tension loads in the beam, substantially equal to the ultimate tensile capacity of the beam, plus significant large moment demands. As discussed earlier herein, "traditional joint connections" inherently have insufficient capacity to resist such axial tension loads resulting from a "double-span" condition caused by loss of the support provided by the column.

The addition of the gusset plates, as taught herein, to the "traditional beams-to-column joint connection", (and, even, to other prior art beams-to-column joint connections), adds the missing attributes needed to achieve substantial blast protection and substantial mitigation of the likelihood of progressive collapse, by the gusset plates being connected, through the use of fillet welds, to both beams and holding them attached to each other even upon failure of the column or failure of the beams-to column joint connections. The gusset plates, when added, provide a beam-to-beam connection to carry tensile loads, while simultaneously providing the moment-resisting capability of the beam-to-beam connection. The added capacities provided by the gusset plates remain even upon failure of the beams-to-column joint connection and/or loss of column support.

The gusset plate connection of the beam-to-beam invention taught herein is designed to have sufficient strength to hold one beam to another, when subjected to gravity loads acting on the "double span" beam that is suddenly created by the violent removal or failure of the column support or partial or complete failure of the joint connections between the beams and the column. The two beams then act as one, "double span" beam.

In other words, assume that suddenly any or all of the following happens in the joint connections between the beams and the column: the support of the column disappears, or is severely compromised during a blast or explosion or other disastrous event; or the gravity load-carrying capability of the beams-to-column joint connection and/or the vertical moment-resisting capability, (that is, the moment-resisting capability about the major axis of the beam), is compromised or lost, as well might happen. This invention of a beam-to-beam gusset plate connection, (which is independent of the column and independent of the beams-to-column joint connections thereto), enables the beams to act like a single, "double-span", long beam, and a catenary capable of carrying gravity loads placed on the beams as a result of such event.

As to such loads, the gusset plates beam-to-beam connections, as taught, herein provide not only the resistance to axial tension from a "double span" catenary, but the gusset plates beam-to-beam connections also provide the capability of resisting vertical moment loading placed on the beam due to the "double-span" condition, as well as resisting severe torsional and lateral moment loading due to other effects originated by a disastrous event.

In other words, this inventive gusset plates connection between beams not only provides additional strength to carry the cable-like, tensile load on the beams, it also provides additional strength against bending of the beams in the vertical plane, (which is, essentially, vertical moment resistance), as well as providing great strength against torsion forces acting on the beams and lateral bending forces acting on the beams, acting as a "double span" beam upon compromise of either the column or beams-to-column joint connection. The "great strength" provided is of a magnitude sufficient to develop the ultimate capacities of the beams in resisting the forces occasioned by the disastrous event.

Prior art "traditional beams-to-column joint connections", even when intact, provide no significant strength against those torsional forces nor significant strength against that lateral bending.

Upon loss of support from the column, the gusset plates connection of beam-to-beam, not only supplies an effective "double-span" gravity load-carrying ability, (although the "double-span" beam may sag a bit), and maintains the tensile capacity of the beams, but also provides resistance against the torsional, vertical and lateral bending moments placed on the beams by the loss of such support.

Inasmuch as a gusset plate is disposed on each side of the beams-to-column joint connections, substantial shielding of those connections is achieved, against a blast, explosion or other lateral force such as might be caused by vehicular crash or impact, thereby increasing the likelihood of preserving the integrity of the beams-to-column joint connections. In addition, there is substantial shielding against air blast shock waves and reflected blast forces, because there is a gusset plate on both sides of the beams-to-column joint connection. The lateral strength of most any beams-to-column joint connection can thus be greatly increased by the addition of gusset plates as taught by this invention.

It can be seen that in a retrofit situation, not having to connect the gusset plates to the column provides an easier and less costly retrofit.

The beams and columns commonly found in steel construction are "H" beams and columns, known to those skilled in the art as "wide flange" shapes, each of which have two flanges and a web interconnecting the two flanges. However, other shapes may be found useful such as built-up box shapes and square or rectangular tube shapes. Tube shapes have radiused corners. It is to be appreciated that such shapes each have four faces to which a beam may be attached directly or indirectly to two of those four faces, on opposite sides of the column. Such structures may be viewed as having two flanges, (the top and bottom), and two webs, (the two sides). As may be visualized, if the structure is a vertical column, the two flanges and the two webs are all vertical.

It is therefore an object of this invention to provide an improved, continuous, beam-to-beam connection across a column, which connection is structurally independent of the column and which connection can mitigate the damage caused by the sudden, violent loss of support from that column or violent loss of joint connections of the beams to the column.

It is another object of this invention to provide an improved beam-to-beam connection across a column, which connection is not dependent on the continued effectiveness of the column nor the beams-to-column joint connections.

Still another object of this invention is to provide a beam-to-beam connection across a column which mitigates the likelihood of progressive collapse of the entire building or similarly heavy structure, upon loss of support from the column or loss of effective beams-to-column joint connections.

It is another object of this invention to provide a beam-to-beam connection at a joint connection of beams to a column, which beam-to-beam connection and said beams can carry the gravity and other loads on said beams upon the loss of column support or loss of beam-to-columns joint connection.

It is another object of this invention to provide a structural beam-to-beam connection which remains effective after violent loss of column support or loss of beam-to column joint connection.

Further objects, features, capabilities and applications of the inventions herein will be apparent to those skilled in the art, from the following drawings and description.

DETAILED DESCRIPTION

Figure 1:
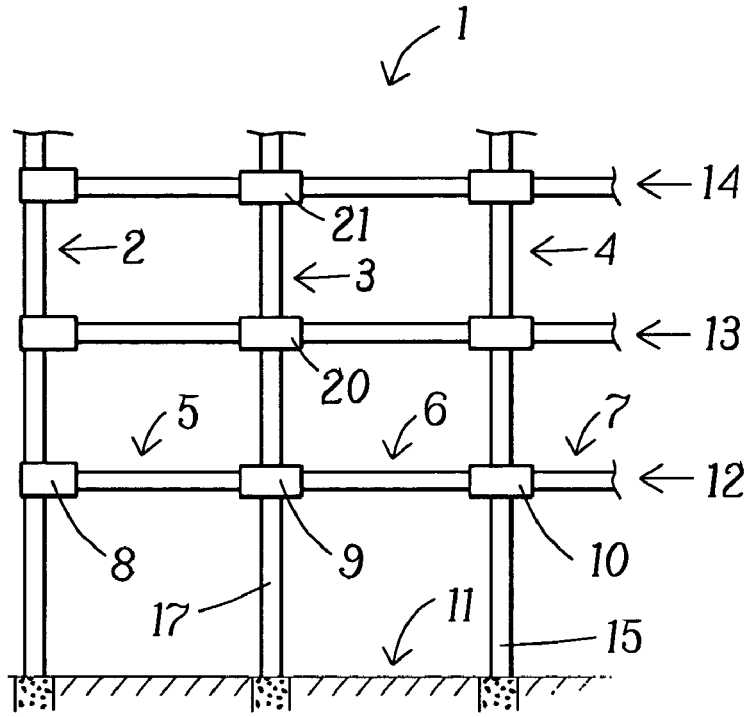
FIG. 1 is a front view of a portion of the framework of a building or similarly heavy structure, illustrating the columns and beams and the gusset plates (which cover the beams-to-column joint connections), disposed as taught by this invention.

The structural steel commonly used in steel frameworks is produced in conformance with standard A-36, A-572 and A-992 specifications. High strength aluminum and other high-strength metals might be found suitable for use in this invention under some circumstances. It is recognized that other materials, particularly in the gusset plates and, possibly, in the joint connections, might be used. For example, in the gusset plates other materials and shapes might be used. There would be required of such gusset plates, that they each be a weldable structure extending along one side of both beams, and having strength equivalent to structural steel plate. The cover plates would be required, in some cases to be weldable, in other cases drillable for bolt or rivet holes. They, too, would have to have the strength equivalent to a similar structural steel plate.

Commonly shown in the drawings herein are fillet welds and full-penetration, single bevel groove welds. The mention or illustration of a particular kind of weld herein, does not preclude the possibility of other kinds of welds being found suitable by a person skilled in the art. In a particular application, it might well be found suitable to use partial-penetration groove welds, flare-bevel groove welds and even other welds and forms of welding.

Most of the welds shown herein are fillet welds. They are the preferred weld between the gusset plates and the flanges of the beams or, if cover plates are used, between the gusset plates and the cover plates. They are also the preferred weld between the vertical shear plates and the beams and between the vertical shear plates and the gusset plates.

Nor is the use of particular shapes of beams and columns necessarily limited to those illustrated and discussed. Other shapes may be found suitable and capable of applying the inventions herein described.

"Attached" herein means welded, bolted or riveted. "Fastened" means bolted or riveted. In retrofitting older structures, riveting may often be found. Modern practice prefers "slip-critical" bolting, using bolts and nuts, washers and oversize bolt holes. "Slip critical" bolting means the bolts are tightened so as not to slip under the designed load.

FIG. 1 is a front view of a portion of the framework of a building 1, tower or similarly heavy structure, illustrating the columns 2, 3 and 4 supporting beams 5, 6 and 7 comprising the first floor 12 of the building. The building 1, tower or similarly heavy structure, whatever the structure is, stands upon ground support 11 or any other base support which is used in the support of such heavy structures. Although shown only in front view, it is to be understood that the structure is three-dimensional and the remainder of the structure is similarly constructed.

A second floor 13 and third floor 14 are shown above the first floor 12. Beams 5 and 6 are connected by a gusset plate 9 and a corresponding gusset plate, which is hidden behind gusset plate 9 in this view, on the other side of the beams 5 and 6 and column 3, as explained hereafter. Beams 6 and 7 are similarly connected by gusset plate 10 and a corresponding gusset plate, which is hidden behind gusset plate 10 in this view, on the other side of beams 6 and 7 and column 4.

Figure 2:
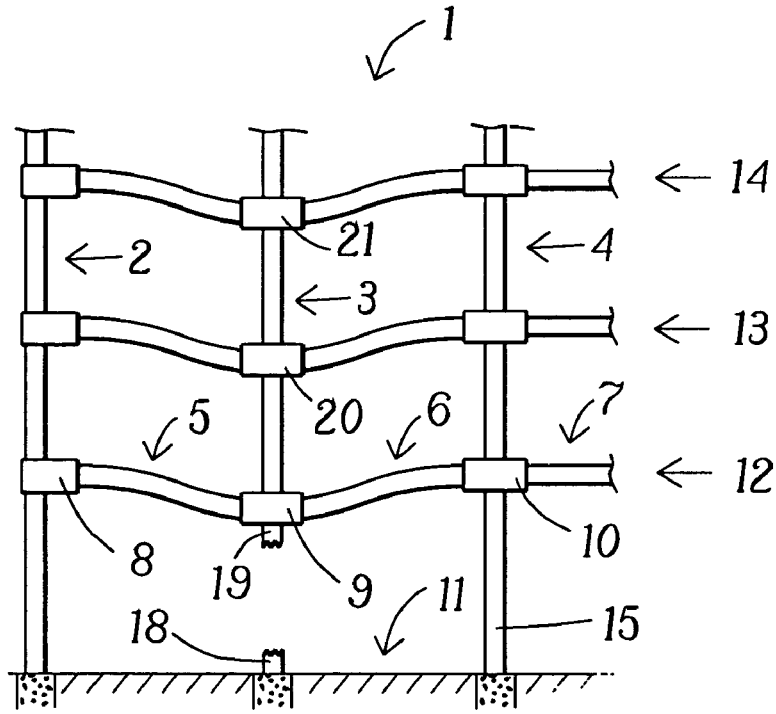
FIG. 2 illustrates the FIG. 1 structure's response to the violent, sudden loss of column support, and the gusset plates maintaining the beam-to-beam connections and assisting the beams at each floor level in carrying the gravity loads placed upon them by a "double-span" condition created by the loss of column support.

The lowest section of column 3 is a bottom section 17 and it will be assumed that some blast, explosion or other violent disaster removes a large portion of bottom section 17, as shown in FIG. 2.

FIG. 2 is the same structure as FIG. 1, illustrating the response of structure 1 to the violent, sudden loss of column 3 support by bottom section 17 having been violently removed and only torn sections 18 and 19 remaining. The gusset plates maintain the continuity of the beam-to-beam connections and assist the beams at each floor level in carrying the gravity and other loads placed upon them by a "double-span" condition made possible by the gusset plates connection, which robustly connects the two "single-span" beams.

The gusset plates 9, 20 and 21 (and their corresponding gusset plates hidden behind them in this view) hold the beams connected together as typified by first floor gusset plate 9 and its corresponding, hidden, gusset plate holding beam 5 to beam 6, notwithstanding the damage to or loss of column bottom section 17, shown in FIG. 1, and, thus, loss of support from column 3. FIG. 2 illustrates that although support from a column is lost, the beams remain connected together by the gusset plates and although the beams may sag, they continue to carry their loads without totally collapsing or initiating collapse of additional columns or the building altogether. The gusset plates assist the beams at each floor level in carrying the gravity loads placed upon them by the "double-span" condition and will, also, maintain substantial tensile strength throughout the length of the "double span" beams 5 and 6, between adjoining columns 2 and 4, because of their inherent reserve design capacity.

Such beam-to-beam connection, by the gusset plates, as taught herein, will also provide substantial resistance to torsion, lateral bending, vertical bending.

The above capabilities are maintained by the gusset plates and their beam-to-beam connection, irrespective of the failure or damaged state of the beam-to-column joint connections or loss of column support.

Additionally, the gusset plates shown in FIG. 2, as exemplified by gusset plates 8, 9, 10, 20 and 21, all provide shielding and protection to the beam-to-column joint connections from blasts, explosions, pressure waves, debris impact and other damaging circumstances. Inasmuch as there is a gusset plate on each side of the beam-to-column joint connection, the shielding and protection is inherently provided on both sides of the joint connection.

Inasmuch as gusset plate 8 does not connect beams on opposing sides of the column 2, the invention herein would not be used in that connection. Rather, gusset plate 8 and its corresponding gusset plate, (hidden from view), would be connected, say, in the manner taught in my U.S. Pat. No. 5,660,017, wherein the gusset plates are fillet welded to the vertical column flanges.

Figure 3:
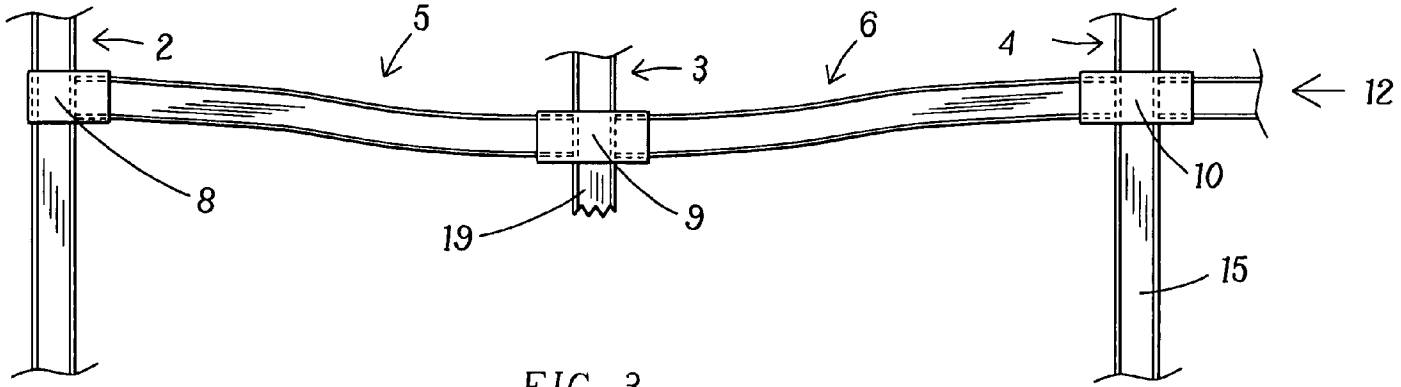
FIG. 3 is a closer view of the bottom floor level of FIG. 2, illustrating the structure's response to the sudden loss of column support, depicting the "double-span" loading exerted on the two beams connected by my invention, which provides beam-to-beam continuity.

FIG. 3 is a closer view of the bottom floor level 12 of FIG. 2, illustrating the structure's response of the first floor 12 to the sudden loss of support from column 3 and the torn section 19. It shows that beams 5 and 6, through the connection maintained by gusset plate 9, and its corresponding hidden gusset plate, form one beam having a "double span" length. The two beams 5 and 6 are under "double-span" loading, and, although they may sag, the two beams remain connected and effective by use of the gusset plates of my invention, which provides beam-to-beam structural continuity.

Figure 4:
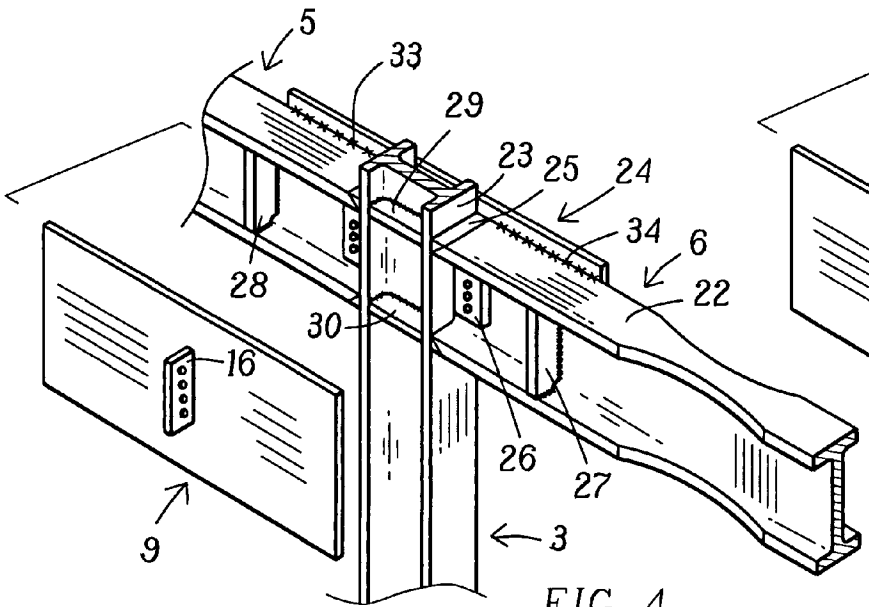
FIG. 4 is an isometric view of one embodiment of the invention having a pair of gusset plates welded, (in the longitudinal direction of the beams), to the flange edges of the two beams which are each connected to the column by a gravity load-bearing connection comprising a vertical shear tab between the web of each beam and a face of the column and which uses a "traditional" RBS, or "dogbone" beam, in a beam-to-column, vertical moment-resisting joint connection of full penetration, single bevel groove welds between the flanges of the beam and the face of the column. The near gusset plate is exploded away, for clarity.

FIG. 4 is an isometric view of the invention, in which a pair of gusset plates 9 and 24, (gusset plate 9 being exploded away for clarity of illustration), are fillet welded to the edges of the top and bottom flanges of two beams 5 and 6. Beams 5 and 6 are "H" beams, or "wide flange shapes". As explained previously, the top flange of each beam is connected by a web to the bottom flange of the beam.

Exemplary fillet welds 33 and 34 show gusset plate 24 is welded to the top flange of beams 5 and 6, respectively. There are similar fillet welds to the bottom flanges of beams 5 and 6. Of course, gusset plate 9, shown expanded away, would also be fillet welded to the near sides of those same flanges. These fillet weld connections comprise the most important part of the beam-to-beam connection, which is a tension and moment connection that will remain effective upon loss of support from column 3, or loss of the beams-to-column joint connections, or both.

The ends the flanges of beams 5 and 6 are connected to column 3 by a "traditional" RBS, or "dogbone", beam-to-column joint connection of full penetration, single bevel groove welds, such as full-penetration, single bevel groove weld 25 between the top flange 22 of beam 6 and the flange 23 of column 3.

All four flanges of beams 5 and 6 are similarly welded by a full-penetration, single bevel groove weld to the flanges of column 3. These welds between the flanges of beams 5 and 6 and the column 3 flanges are vertical moment-resistance connections, which moments are about the major axes of the beams 5 and 6. As can be seen, beam 5 extends away from column 3 on one side of the column and beam 6 extends away from the column 3 on the other side of the column.

Beam 6 is also connected to one flange of column 3, in a gravity load-carrying connection, by vertical shear tab 26. Beam 5 is similarly connected to the other flange on the other side of column 3 by another vertical shear tab (not visible). A vertical shear tab 16, welded to gusset plate 9 illustrates a means for connecting a beam orthogonally to gusset plate 9.

The gusset plates 9 and 24 are fillet welded to the top and bottom flanges of beams 5 and 6, as previously described. Gusset plate 9, when assembled, may or may not be fillet welded to continuity plates 29 and 30 and, also, gusset plate 9 would be fillet welded to vertical shear plates 27 and 28, if vertical shear plates are used. Gusset plate 24 may or may not be similarly fillet welded to corresponding continuity plates (not visible) on the other side of column 3, and vertical shear plates (not visible) corresponding to vertical shear plates 27 and 28, on the other side of beams 5 and 6, if vertical shear plates are used.

The gusset plates 9 and 24 are not directly welded or bolted or riveted to column 3.

Thus, the gusset plates connect the beams together, independently of the beams-to-column joint connections, which, as described above, are comprised of vertical shear tabs between beam webs and the column flanges and full penetration, single bevel groove welds between the beam flanges and the column flanges.

The beams 5 and 6 could, of course, be beams of other shapes. Also, other beams-to-column joint connections than those shown or discussed, may be used in this invention. Vertical shear plates connecting a beam's web to gusset plates may or may not be used in various structures and are sometimes omitted. When included, vertical shear plates effectively provide additiional strength in tension, shear and moment resistance, to better withstand a "double span" condition created by a compromised column or a column having a compromised beams-to-column joint connection.

As explained previously, in applying the gusset plates of the invention to beams-to-column joint connections, it is required that the beams-to column joint connections, at columns adjacent to the location of a postulated removed, (or otherwise compromised), column and/or loss or compromise of its beams-to-column joint connection, due to a disaster, be capable of carrying the significant axial tensile load from the "double span" beam condition which results. Thus, the beams-to-column joint connections, each comprised of a gravity load-carrying connection and a vertical moment-resisting connection, should be strong enough, or else made strong enough, to develop an axial tension substantially equal to the tensile capacity of the beams. The beams-to-column joint connections at such columns, which are adjacent to a compromised column, must also, have a significant vertical moment-resisting capability. It is pointed out that it will not be known beforehand which column or columns will be compromised, therefore, all columns could be considered "adjacent".

Concurrently, at the location of a removed or damaged column, the gusset plates not only provide shielding to the beams-to-column joint connection, but, also, are capable of developing the ultimate axial tensile strength and vertical moment flexural strength of the beams upon the occurrence of a blast, explosion or other disastrous event. In addition, substantial "torsional" strength and "lateral moment" strength are provided by such gusset plates.

Notwithstanding the above as to the importance of the beams-to-column joint connection for two beams having a substantial moment-resisting capability on both sides of the column, an alternative embodiment allows one side of a column to have a beam-to-column joint connection with insufficient or no vertical moment-resisting connection or capability, provided the other side of the column does have a beam-to-column joint connection with the substantial moment resistance capability described hereinabove; and, provided that no two of such alternative, beams-to-column joint connections be placed in succession in the same row of columns.

Figure 5:
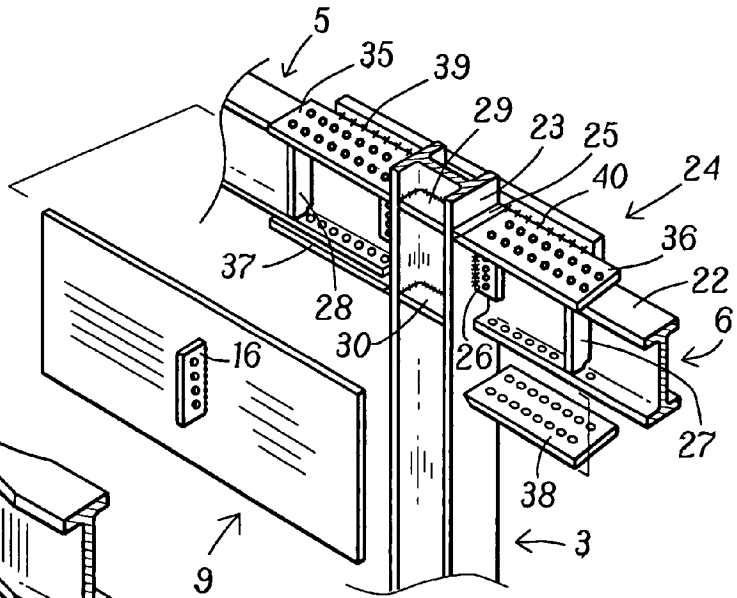
FIG. 5 is an isometric view of another embodiment of the invention in which two gusset plates are welded, (in the longitudinal direction of the beams), to longitudinal edges of cover plates which are bolted to the top and bottom flanges of the beams, which beams are connected to the column in a gravity load-bearing connection using a vertical shear tab, and which embodiment also uses a "traditional" beam-to-column, vertical moment-resisting joint connection in common use—that of full penetration, single bevel groove welds between the cover plates and the face of the column. The near gusset plate is exploded away, for clarity.

FIG. 5 is an isometric view of another embodiment of the invention, with the nearer gusset plate 9 exploded away for clarity. The connection means between the gusset plates 9 and 24 and the beams 5 and 6 is different in this embodiment. The two gusset plates 9 and 24 are, in this embodiment, fillet welded to longitudinal edges of cover plates 35, 36, 37 and 38 which are bolted to the top and bottom flanges of beams 5 and 6. Cover plate 38 is exploded downwardly for clarity, but it is to be understood that it would be bolted to the bottom flange of beam 6. The beams 5 and 6 are illustrated as being common "H" beams, although they could be other shapes.

The flanges of the beams 5 and 6 are not wide enough, when gusset plate 9 is assembled up against column 3, to reach from gusset plate 9 to gusset plate 24. Therefore, cover plates 35–38 are bolted to the flanges of beams 5 and 6, to, in effect, widen the flanges of the beams 5 and 6 so they can be fillet welded to gusset plates 9 and 24.

Each of the gusset plates 9 and 24 is fillet welded to every cover plate as shown by the exemplary fillet welds 39 and 40. As can be seen, such fillet welds extend in the longitudinal direction of the beams. Similar to the FIG. 4 embodiment, the gusset plate 9 is also welded to vertical shear plates 27 and 28, and, may or may not be welded to continuity plates 29 and 30. Gusset plate 24 is similarly welded to corresponding vertical shear plates, (not visible), and continuity plates, (not visible), on the other side of beams 5 and 6 and column 3.

Dissimilar to the beams-to-column joint connection of FIG. 4, the flanges of beams 5 and 6 are not welded to the flanges of column 3, but are spaced away therefrom. The "traditional" beams-to-column joint connection, in this instance, uses full-penetration, single bevel groove welds between the cover plates 35–38 and the flanges of column 3, as exemplified by weld 25 between cover plate 36 and flange 23 of column 3. Also, the webs of beams 5 and 6 are attached to the flanges of column 3 by vertical shear tabs, such as shear tab 26, which is bolted to the web of beam 6 and fillet welded to the flange 23 of column 3.

As in FIG. 4, in FIG. 5, gusset plates 9 and 24 are not welded to or bolted to or directly attached to column 3.

Such beam-to-beam connection, using the gusset plates of the invention, is capable of resisting axial tensile forces and flexural moments to the ultimate capacity of the beams. Thus, the ultimate capacity of the beams is developed in the event of extreme loads placed on them by blast, explosions, earthquakes, tornadoes and other disastrous events.

Figure 6:
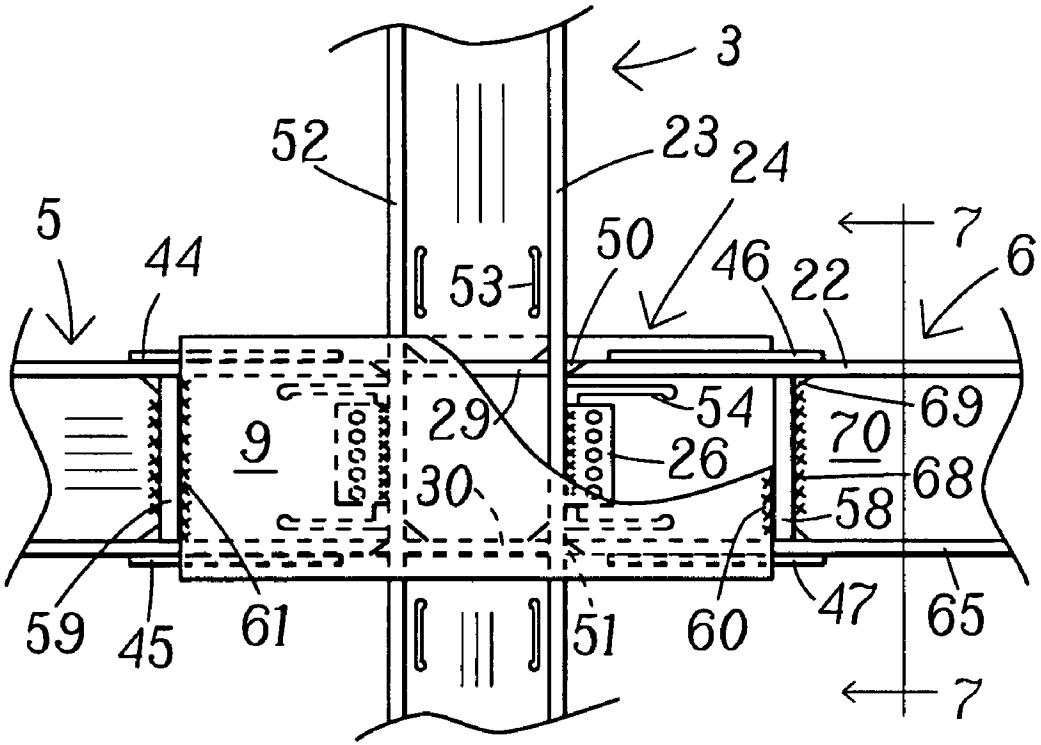
FIG. 6 is a side view of still another embodiment of the invention showing two gusset plates, (the near gusset plate being partially broken away), which gusset plates are welded by longitudinal fillet welds to the edges of cover plates, which are welded by longitudinal fillet welds to the two beams. The beams are connected to the column in a gravity load-bearing connection using vertical shear tabs between the webs of the beams and faces of the column, and in which the beam flanges are welded to the faces of the column in a "traditional" beam-to-column, vertical moment-resisting joint connection using full penetration, single bevel groove welds between the beam flanges and the faces of the column. The beams and columns are shown as slotted to distribute stress and strain in the joint connection area. Also shown are two vertical shear plates, which are each welded to a gusset plate and to the adjacent side of each beam.

FIG. 6 is a side view of still another embodiment of the invention showing two gusset plates, 9 and 24, (the near gusset plate 9 being partially broken away), which are welded by longitudinal fillet welds (not shown) to the edges of cover plates 44–47, similar to the embodiment of FIG. 5. The cover plates 44 and 45 are fillet welded to the top and bottom flanges of beam 5 and cover plates 46 and 47 are fillet welded to the top and bottom flanges of beam 6. The cover plates are welded by longitudinal fillet welds to the two beams.

As previously described, vertical shear tab 26 is bolted to the web 70 of beam 6 and is fillet welded to the flange 23 of column 3. A similar vertical shear tab connects the web of beam 5 to the flange 52 of column 3. These vertical shear tab joint connections provide a gravity loading-carrying connection between the beams 5 and 6 and the column 3.

The beams 5 and 6 are connected to column 3 by a "traditional" beam-to-column joint connection comprising the full-penetration, single bevel groove welds as described previously, between the flanges of the beams and the column flanges. Full-penetration, single bevel groove welds 50 and 51 show how the flanges 22 and 65 of beam 6 are welded to flange 23 of column 3. The flanges of beam 5 are similarly welded to the other flange 52 of column 3. These groove welds between the flanges of the beams 5 and 6 and the column flanges 52 and 23, respectively, provide a substantial vertical moment-resisting connection between the beams 5 and 6 and the column 3 when protected and shielded by the gusset plates of this invention. Because of this protection and shielding, such vertical moment-resisting connection is capable of developing the ultimate capacity of the beam.

The beams and columns in this embodiment use slots and/or holes to distribute the stress and strain in the joint connection area. Such beams and columns are taught in prior art U.S. Pat. No. 6,237,303 to Clayton J. Allen, mentioned above as a post-Northridge stress reduction and distribution concept.

Column slot 53 typifies the slots in the web of column 3. Beam slot 54, which lies in web 70, just under the flange 22 of beam 6, typifies the beam slots in both beams 5 and 6.

Vertical shear plates 58 and 59 are disposed differently than the previously-described vertical shear plates. In this embodiment, the vertical shear plates 58 and 59 are shown disposed adjacent the end of gusset plates 9 and are welded thereto by fillet welds 60 and 61. Of course, there are corresponding vertical shear plates, (not visible), on the other side of beams 5 and 6.

Figure 7:
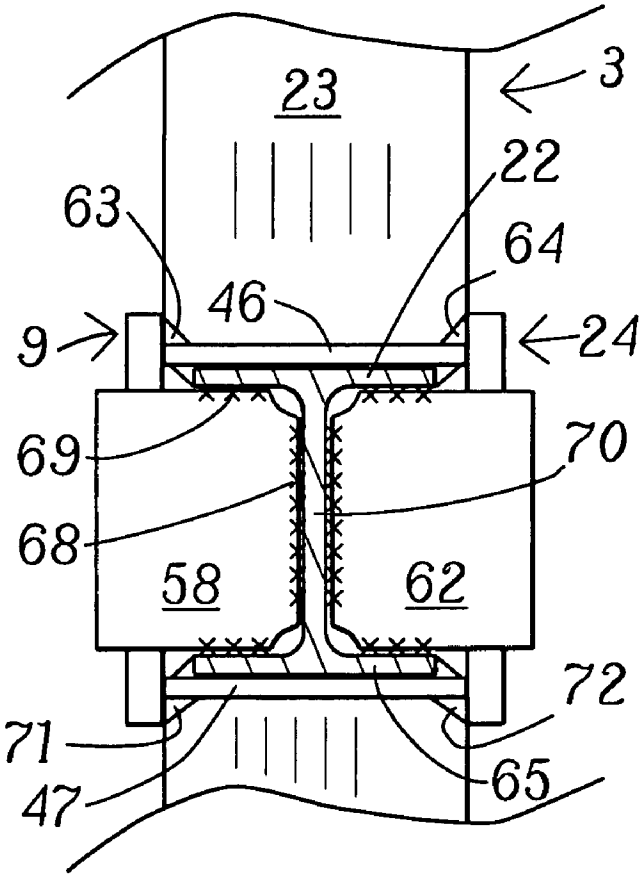
FIG. 7 is a cross-section, expanded for clarity, taken on line 7—7 in FIG. 6, showing the fillet welds between the beam flanges and their top and bottom cover plates, and the fillet welds between the top and bottom cover plates and the gusset plates. Also shown are two vertical shear plates, illustrating how they are located and how they are welded to the web and flanges of the beam.

FIG. 7 is a cross-section, expanded for clarity, taken on line 7—7 in FIG. 6, showing vertical shear plate 58 and its "corresponding" vertical shear plate 62. The "corresponding" vertical shear plates have been hidden in the previous views, but it can be seen that corresponding vertical shear plate 62 lies between the flanges of beam 6 and is fillet welded to the flanges and web of beam 6, as is vertical shear plate 58, directly opposite, on the other side of beam 6. Vertical shear plate 62 is welded to gusset plate 24 in the same manner vertical shear plate 58 is welded to gusset plate 9—by a fillet weld (not visible in this view) such as fillet weld 60, illustrated in FIG. 6.

In FIG. 7, the top flange 22 of beam 6 is fillet welded to the bottom of cover plate 46 which is, in turn, fillet welded, along its topside, to gusset plates 9 and 24 by fillet welds 63 and 64, (seen in end view), which run longitudinally between the cover plate 46 and the gusset plates 9 and 24. The bottom flange 65 of beam 6 is likewise fillet welded to cover plate 47 which is likewise fillet welded to gusset plates 9 and 24 by fillet welds 71 and 72, (seen in end view). Cover plates 44 and 45, FIG. 6, are similarly welded to the top flange and to the bottom flange of beam 5, respectively, and to both of the gusset plates 9 and 24. It may be in some constructions that the vertical shear plates are not required and the longitudinal fillet welds between the gusset plates and the beam flanges, (or cover plates attached to the beam flanges), of this invention, are strong enough to resist all applied loads.

In other words, the gusset plates are fixedly attached, with respect to each beam, by a tension and moment connection which can carry the axial tension of a "double-span" tensile load between the beams upon loss of support from the column, or upon the loss of integrity of the beam-to-column-to-beam joint connection, and, also, resists moments substantially equal to the flexural capacity of said beams upon loss of support from or joint connection to, said column.

As can be seen, tension and moment strength is obtained from the longitudinal welds between the gusset plates and the beams, holding the beams together, whether or not there is any support from the column. Increased moment strength from the gusset plates is obtained about both the major axis, (the stronger axis), of each of the beams and the minor axis, (the weaker axis), of each of the beams. The present invention provides tension and moment joint connections in which the gusset plates provide both significant torsional resistance, and bending resistance about the minor axis of each of the beams at the connection.

Such may be accomplished without narrowing the flanges of the beams as in the RBS or "dogbone" connection and without putting slots or holes in beams or columns, as done in some post-Northridge connections. It is noted that this invention is compatible with and can be applied to the pre-Northridge and post-Northridge connections and most any other suitable beam-to column joint connection used in buildings and similarly heavy structures, assuming the beams-to column joint connection can develop significant vertical moment resistance, and can carry, or can be strengthened to carry, significant tensile load, as will occur upon the "double-span" condition being created by the loss of support from a column or loss of joint connections.

Use of gusset plates adds substantial torsional and lateral strength to the joint connection and, thus, to connections throughout the structure. Strength in the lateral direction, it is noted, is strengthening the joint connections in their "weak axis" direction.

Figure 9:
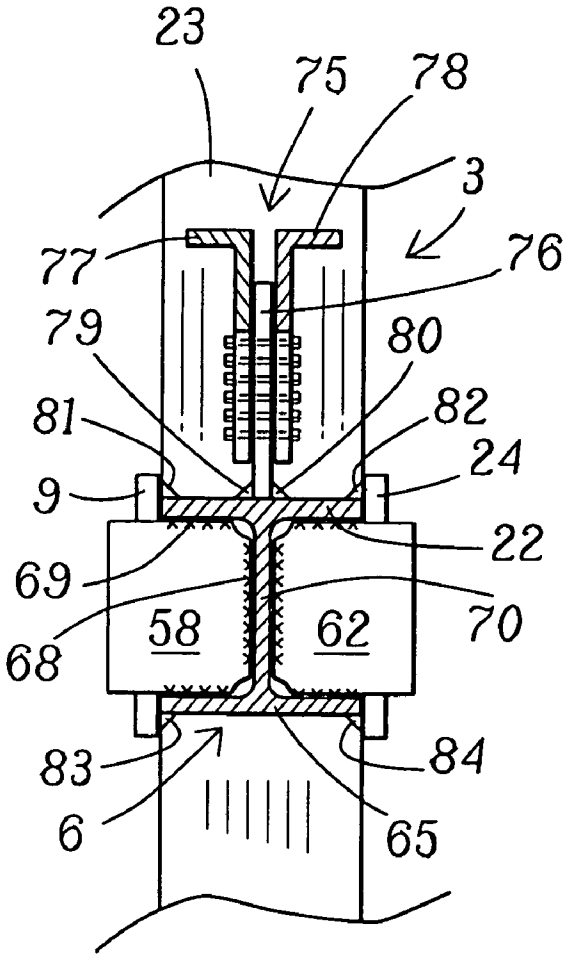
FIG. 9 is a cross-section taken on line 9—9, FIG. 8, showing two vertical shear plates, welded on opposite sides of the beam, to the beam flanges and to the web of the beam. The near ends of the fillet welds between the gusset plates and the top and bottom flanges of the beam are shown. Also shown are the fillet welds between the vertical plate and the top of the beam.
Figure 8:
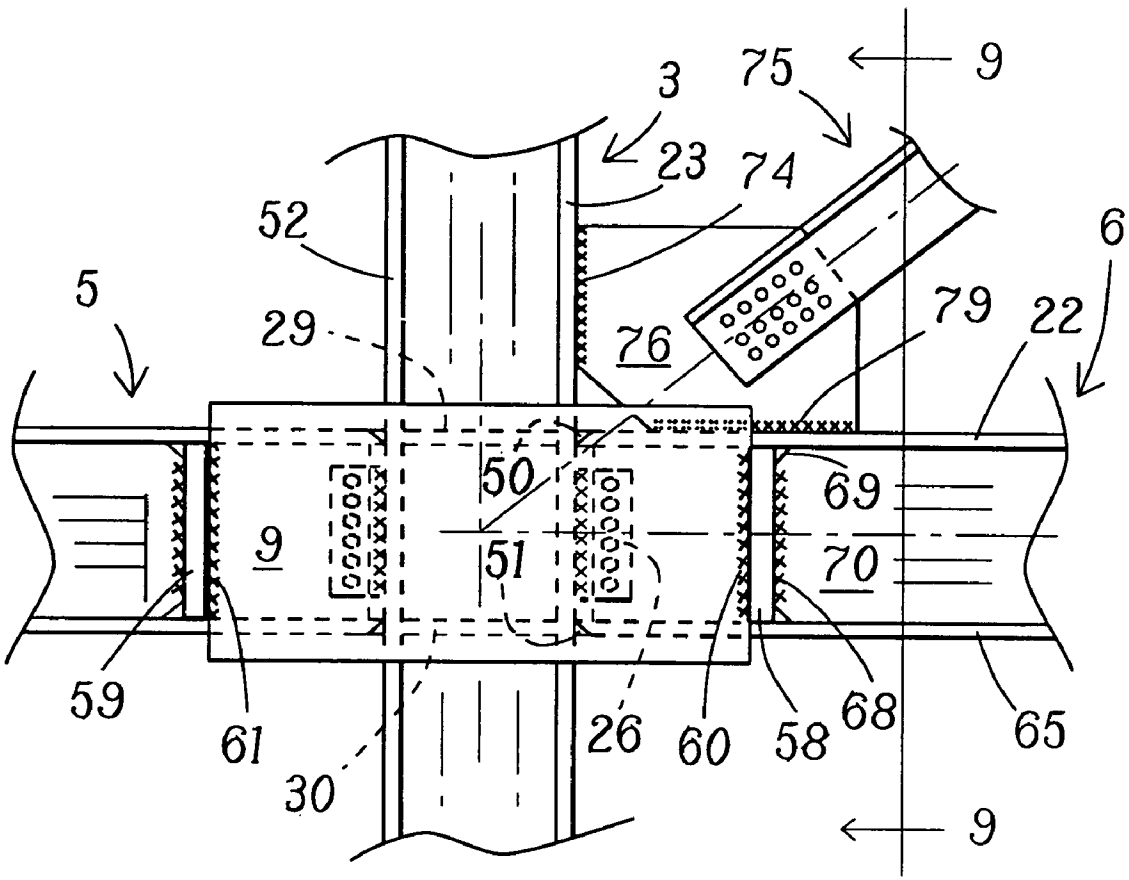
FIG. 8 is an illustration of the invention used in a joint connection having a diagonal brace, but with beams wide enough to not require the use of cover plates. The diagonal brace, as shown hereafter in FIG. 9, is comprised of two parallel structural angles bolted to a vertical plate welded to both column and beam. The beams are connected to the column in a gravity load-bearing connection comprised of vertical shear tabs between the webs of the beams and the faces of the column. The flanges of the beams are welded to the faces of the column using full penetration, single bevel groove welds, providing a vertical moment-resisting connection between each beam and the column.

FIG. 8 is an illustration of the invention used in a joint connection having a diagonal brace 75, but with beams 5 and 6 wide enough to not require the use of cover plates. The diagonal brace 75, as shown hereafter in FIG. 9, is comprised of two parallel structural angles bolted to a vertical plate 76, which is shown fillet welded to flange 23 of column 3 by fillet weld 74 and to flange 22 of beam 6 by fillet weld 79. The beam 6 is connected to the flange 23 of column 3 in a gravity load-bearing connection comprised of vertical shear tab 26 between the web 70 of beam 6 and the flange 23 of column 3. The four flanges of the beams are welded to the faces of the column using full penetration, single bevel groove welds, providing a vertical moment-resisting connection between each of the beams and the column. Typical of such welds are welds 50 and 51 between the flanges 22 and 65 of beam 6 and flange 23 of column 3.

Vertical shear plates 58 and 59 are shown fillet welded to both the beams 5 and 6 and to gusset plate 9. For example, fillet weld 60 attaches vertical shear plate 58 to gusset plate 9 and fillet weld 68 attaches vertical shear plate 58 to web 70 of beam 6. Vertical shear plate 59 is similarly fillet welded to beam 5 and gusset plate 9.

FIG. 9 is a cross-section taken on line 9—9, FIG. 8, showing brace 75 comprised of two angle irons 77 and 78 bolted on opposite sides of vertical plate 76 which is fillet welded to beam flange 22 by fillet welds 79 and 80. Also shown are two vertical shear plates 58 and 62, fillet welded on opposite sides of beam 6, to the beam flanges 22 and 65 and to the web 70 of beam 6. The near ends of the fillet welds 81–84 between the gusset plates 9 and 24 and the top and bottom flanges 22 and 65 of the beam 6 are shown.

Although the brace 75 shown is comprised of two structural angles 77 and 78, the brace 75 could be of other shapes, including tube steel, channel sections, "H" sections and, even other shapes.

Alternatively, too, the vertical shear plates, such as 58 and 62, could be located just inside the vertical edge of the gusset plates 9 and 24, or, eliminated altogether in some designs.

Figure 10:
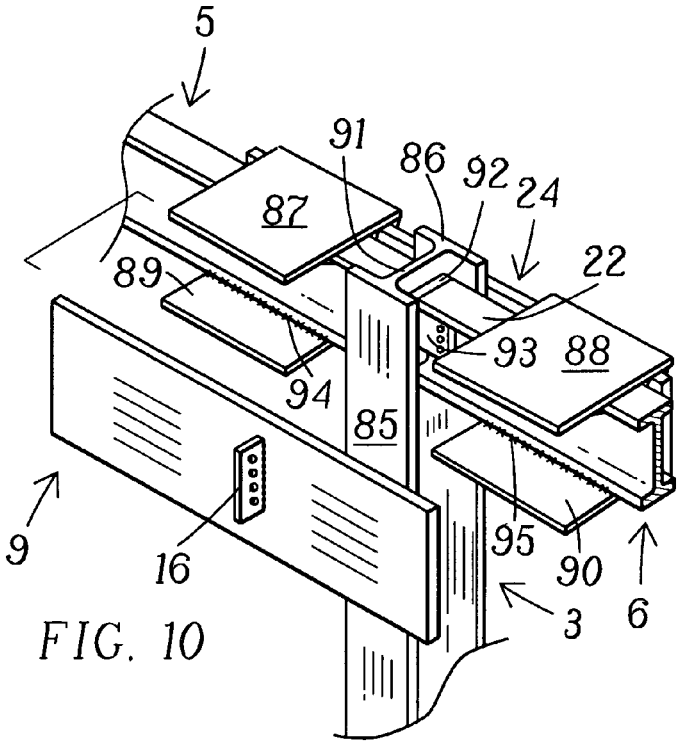
FIG. 10 illustrates an embodiment of the invention in which cover plates extend from the beams outwardly over the gusset plates. For clarity the near gusset plate is expanded away. The beams are connected to the web of the column, rather than to the face, as in the previous Figs. Also, the gusset plates extend from beam-to-beam, across the face of the column rather than across the flange edges of the column as in the previous Figs.

FIG. 10 illustrates an embodiment of the invention in which column 3 is rotated 90 degrees from previously—described embodiments. In this embodiment, the gusset plates 9 and 24 extend across the faces of the flanges 85 and 86 of column 3, rather than across their edges, as in prior embodiments. Beams 5 and 6 are not connected to such flanges, nor to column 3 in any direct connection.

For clarity, the near gusset plate 9 is expanded away. The ends of the flanges of beams 5 and 6 are connected to the web 91 of the column 3, by full penetration, single bevel groove welds, such as weld 92. The webs of beams 9 and 24 are also connected to the web 91 of column 3 by vertical shear tabs, such as vertical shear tab 93, bolted to the web of beam 6 and fillet welded to web 91 of column 3. Beam 5, of course, uses a similar vertical shear tab, (not visible), to connect to the opposite side of web 91 of column 3. Cover plates 87–90 extend from the beams 5 and 6 outwardly over the gusset plates 9 and 24. Such cover plates are fillet welded to beams 5 and 6 by fillet welds, typified by fillet welds 94 and 95.

Figure 11:
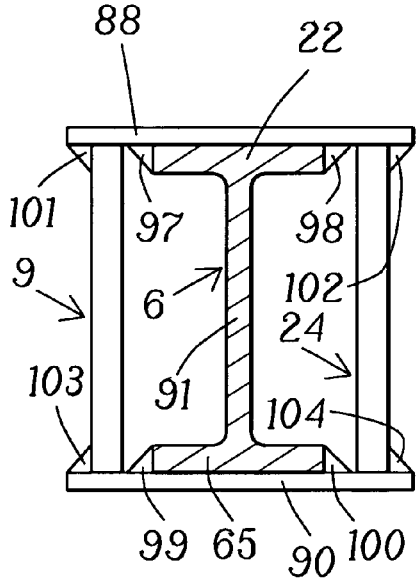
FIG. 11 is an end view of selected elements of FIG. 10, showing how the top and bottom beam flanges are fillet welded to the top and bottom cover plates and how the top and bottom cover plates extend over the gusset plates and are fillet welded to the gusset plates.

FIG. 11 is an end view of selected elements of FIG. 10, showing how the top flange 22 of beam 6 is welded to top cover plate 88 by fillet welds 97 and 98, seen in end view. Bottom flange 65 of beam 6 is likewise fillet welded to bottom cover plate 90 by fillet welds 99 and 100, seen in end view. Top cover plate 88 is fillet welded to gusset plate 9 and 24 by fillet welds 101 and 102, seen in end view. Bottom cover plate 90 is fillet welded to gusset plates 9 and 24 by fillet welds 103 and 104, likewise seen in end view.

Figure 12:
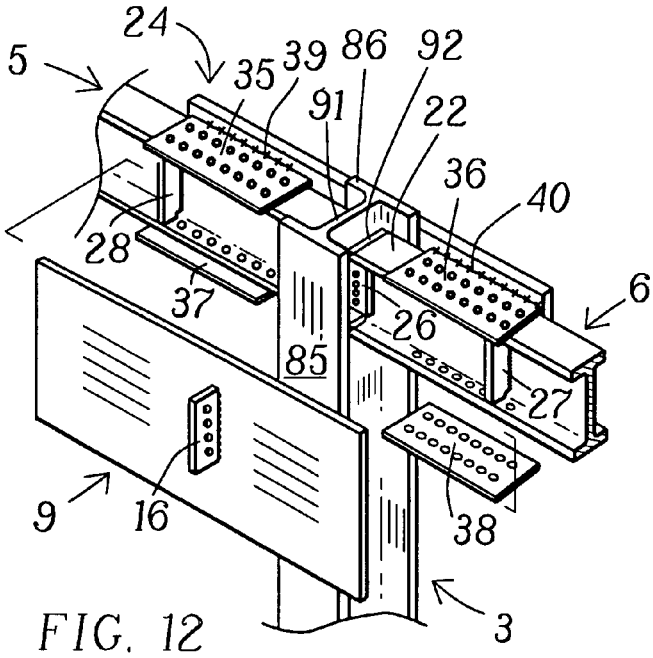
FIG. 12 illustrates an embodiment of the invention in which the cover plates are bolted to the beam flanges and the gusset plates are fillet welded to the cover plates. The beams are connected to the column web and the gusset plates extend from beam to beam, across the face of the column rather than across the flange edges of the column. For clarity, the near gusset plate is exploded away and one of the bottom cover plates is shown exploded downwardly.

FIG. 12 illustrates an embodiment of the invention somewhat similar to that shown in FIG. 5, except the column is rotated 90 degrees and the gusset plates 9 and 24 extend from beam to beam across the face of the column rather than across the flange edges of the column 3.

Top cover plates 35 and 36 are bolted to the top flanges of beams 5 and 6. Similar cover plates 37 and 38 are bolted to the bottom flanges of beams 5 and 6. The gusset plate 24 is fillet welded to top cover plates 35 and 36 by fillet welds 39 and 40. Gusset plate 24 is similarly welded to bottom cover plates 37 and 38 bolted to the bottom flanges of beams 5 and 6.

Gusset plate 9, is exploded away for clarity, and bottom cover plate 38 is exploded downwardly for clarity. However, like gusset plate 24, gusset plate 9 is also fillet welded to the top and bottom cover plates 37–40 in the manner of the fillet welds 39 and 40 shown between top cover plates 35 and 36 and gusset plate 24.

The beams 5 and 6 are connected to the column web in a gravity loading carrying connection by vertical shear tabs, typified by vertical shear tab 26.

Vertical shear plates 27 and 28 are shown disposed inwardly from the end of the gusset plate 9. They, too, would be fillet welded to both gusset plate 9 and beam 6 as discussed in connection with FIG. 5. There are, of course, corresponding vertical shear plates opposite those shown, on the other side of the beams, fillet welded between the other side of the beams and gusset plate 24.

Figure 13:
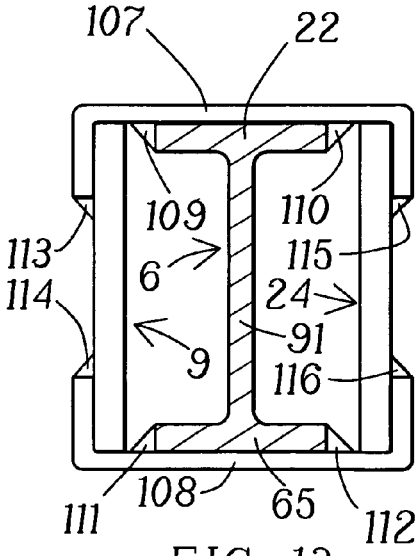
FIG. 13 is an illustration of the invention similar to that illustrated in FIGS. 10 and 11, showing cover plates which are "U" shaped and the gusset plates and the top and bottom flanges of the beam are fillet welded to the "U" shaped cover plates.

FIG. 13 is an illustration of the invention similar to that illustrated in FIGS. 10 and 11, except that the cover plates are "U" shaped. Top flange 22 of beam 6 is fillet welded by fillet welds 109 and 110, seen in end view, to "U" shaped cover plate 107. Bottom flange 65 of beam 6 is fillet welded to "U" shaped cover plate 108 by fillet welds 111 and 112.

The "U" shaped cover plates 107 and 108 are fillet welded to gusset plate 9 by fillet welds 113 and 114, seen in end view and the "U" shaped cover plates 107 and 108 are fillet welded to gusset plate 24 by fillet welds 115 and 116, also seen in end view.

Figure 14:
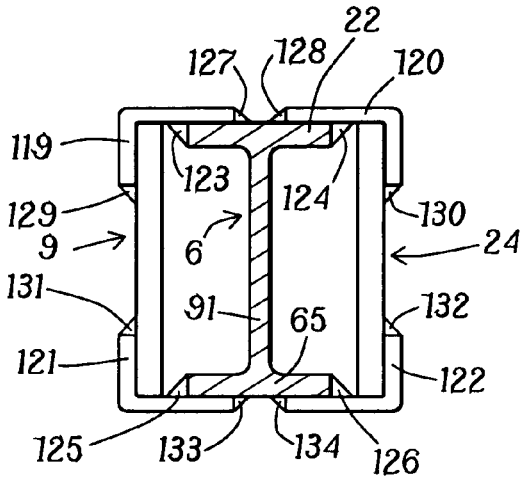
FIG. 14 is a variation of the embodiment of FIG. 13, using structural angles instead of "U" shaped cover plates, in which the gusset plates and the top and bottom flanges of the beam are fillet welded to the structural angles.

FIG. 14 is a variation of the embodiment of FIG. 13, using structural angles 119–122, as cover plates, instead of "U" shaped cover plates, to allow longitudinal welds between the gusset plates 9 and 24 and the beams, of which beam 6 is shown. Top and bottom flanges 22 and 65 of beam 6 are fillet welded to the structural angles 119–122, by inside fillet welds 123–126 and outside fillet welds 127, 128, 133 and 134. Such fillet welds are shown in end view. Gusset plates 9 and 24 are fillet welded to the structural angles 119–122, by fillet welds 129–132. All such fillet welds are shown in end view. As can be understood, the gusset plates 9 and 24 are thus connected through structural angles 119–122 to beam 6 by longitudinal fillet welds, all extending in the direction of the beam 6. In this embodiment, gusset plates 9 and 24 extend across column 3 to beam 5 (not shown) to which gusset plates 9 and 24 would be similarly fillet welded through the use of structural angles. Gusset plates 9 and 24, being thus fixedly attached with respect to both beam 5 and beam 6, across column 3, are not directly welded or fastened to column 3, in accordance with the invention.

Figure 15:
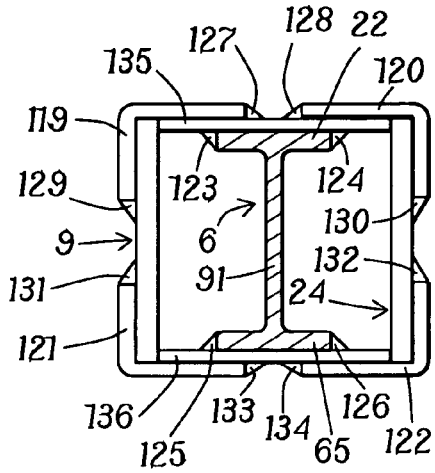
FIG. 15 illustrates an embodiment of the invention similar to that shown in FIG. 14, but adding cover plates between the top and bottom flanges of the beam and the structural angles. The cover plates are fillet welded to the top and bottom flanges of the beams and to the structural angles. The structural angles are also fillet welded to the gusset plates.

FIG. 15 illustrates an embodiment of the invention similar to FIG. 14, but adding cover plates 135 and 136 between the top and bottom flanges 22 and 65 of the beam 6 and the structural angles 119–122. The cover plates 135 and 136 are fillet welded to the top and bottom flanges 22 and 65 of beam 6 by fillet welds 123–126. Cover plates 135 and 136 are fillet welded to structural angles 119–122 by fillet welds 127, 128, 133 and 134. Gusset plates 9 and 24 are fillet welded to structural angles 119–122 by fillet welds 129–132. The fillet welds, (seen in end view), in accordance with the invention, extend longitudinally in the direction of beam 6. Gusset plates 9 and 24 would extend across column 3 to be fixedly attached with respect to beam 5 through the use of fillet welds, cover plates and structural angles as shown in the connection of gusset plate 9 and 24 with respect to beam 6. "Structural angles" include, but are not limited to, "angle irons".

Figure 16:
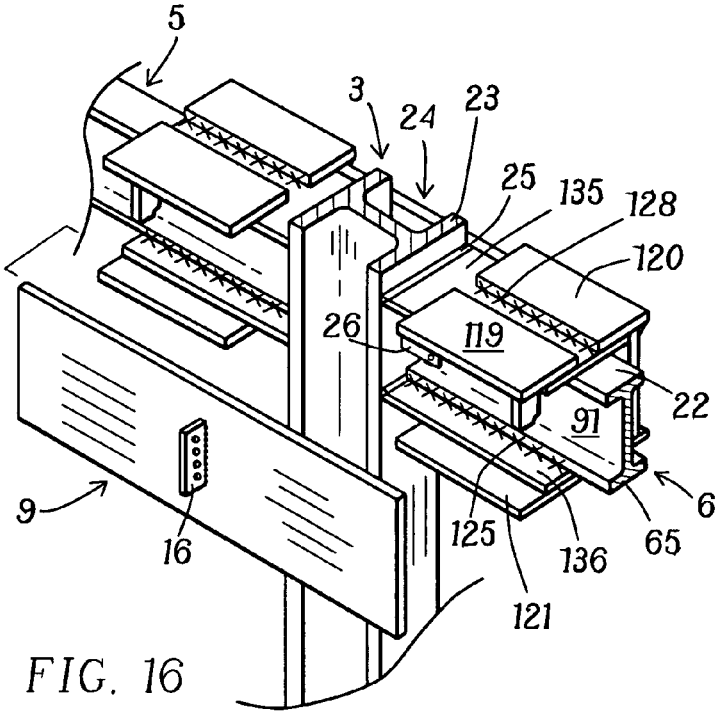
FIG. 16 illustrates use of the invention with a prior art beam-to-column joint connection in which a wide cover plate is attached to each flange of each beam and such wide cover plate is welded to a flange of the column by a full penetration, single bevel groove weld, providing a vertical moment-resisting joint connection between the beam and the column. In order to attach the gusset plates to the beams, two additional, narrower cover plates are fillet welded, (not shown, but shown in FIG. 17), to each wide cover plate and the gusset plates are fillet welded to the narrower cover plates. The near gusset plate is exploded away for clarity.

FIG. 16 illustrates use of the invention with a prior art beam-to-column joint connection in which a wide cover plate, such as top wide cover plate 135 is fillet welded to each flange of each of beams 5 and 6, making four wide cover plates. The near gusset plate 9 is exploded away for clarity. Wide cover plate 135 is welded to flange 23 of column 3, by a full penetration, single bevel groove weld 25. Bottom wide cover plate 136 is seen attached by fillet weld 125 to bottom flange 65 of beam 6 and is similarly welded to flange 23 of column 3 by a full penetration, single bevel groove weld. All four wide cover plates are similarly groove welded to a flange of column 3, providing a vertical moment-resisting joint connection between each of the beams 5 and 6 and column 3.

In order to attach the gusset plates 9 and 24 with respect to beam 6, narrower cover plates are used to widen the structure. Narrower cover plate 120 is fillet welded by fillet weld 128 to top wide cover plate 135. Narrower cover plate 119 is similarly fillet welded to top wide cover plate 135. There is also a bottom wide cover plate 136 which is fillet welded to bottom flange 65 of beam 6 by fillet weld 125. Two bottom narrower cover plates, of which only 121 is visible, are fillet welded to bottom wide cover plate in the same manner as the top narrower cover plates 119 and 120 are fillet welded to top wide cover plate 135. The gusset plates 9 and 24 are then fillet welded, (not shown, but illustrated better in FIG. 17), to the narrower cover plates, in order to fixedly attach gusset plates 9 and 24 with respect to beam 6.

Figure 17:
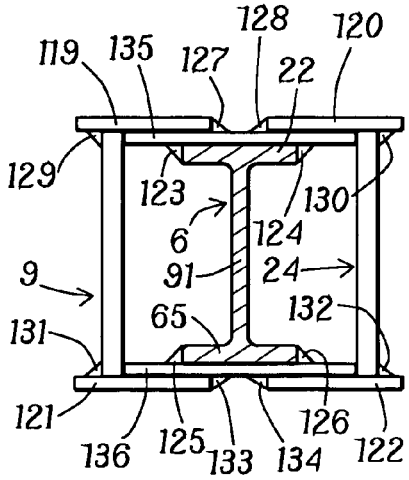
FIG. 17 is an end view of selected elements of FIG. 16, illustrating the gusset plates fillet welded to the narrower cover plates, which are, in turn, fillet welded to the wide cover plates, which are fillet welded to the top and bottom flanges of the beam.

FIG. 17 is an end view of selected elements of FIG. 16, illustrating the gusset plates 9 and 24 attached to the top and bottom narrower cover plates 119–122 by fillet welds 129–132. Top and bottom narrower cover plates 119–122 are, in turn, attached to top and bottom wide cover plates 135 and 136 by fillet welds 127, 128, 133 and 134. Top and bottom wide cover plates 135 and 136 are attached to the top and bottom flanges 22 and 65 of beam 6, by fillet welds 123–126.

Beam 5 is connected with respect to gusset plates 9 and 24 in the manner described in connection with beam 6. Beam 5 has top and bottom wide cover plates, (welded to the far side of column 3 by full penetration, single bevel groove welds), with top and bottom narrower cover plates fillet welded to top and bottom wide cover plates.

Figure 18:
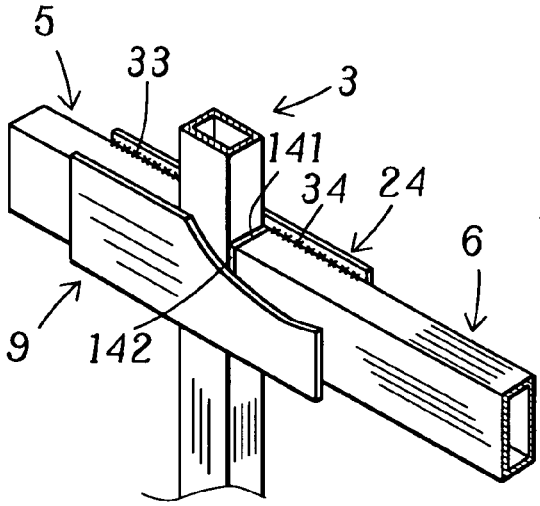
FIG. 18 illustrates the invention with box beams whose flanges, (top and bottom of the box beam), and whose sides are welded, in a vertical direction, to the box column by full penetration, single bevel groove welds, with gusset plates fillet welded directly to the box beams with fillet welds running in the longitudinal direction of the beams.

FIG. 18 illustrates the invention with beams 5 and 6 being in the form of box beams, the ends of whose top and bottom flanges are all welded by full penetration, single bevel groove welds, such as weld 141 to a column, here shown as a box column 3. The gusset plate 24 is fillet welded, by fillet welds 33 and 34 directly to the box beams 5 and 6 with the fillet welds running in the longitudinal direction of beam 6. Gusset plate 9 is similarly fillet welded to box beams 5 and 6.

Gusset plate 9 is shown cut away in order to illustrate the gravity load-carrying connection between box beam 6 and column 3. Vertical, full-penetration, single bevel groove weld 142 connects one side of box beam 6 to column 3. The other side of box beam 6 is similarly welded (not visible) by a vertical, full-penetration, single bevel groove weld to column 3. Box beam 5 has both of its sides similarly welded to column 3 on the opposite side thereof from box beam 6. Such vertical welds between the box beams 5 and 6 and column 3 provide the gravity load-carrying connections comparable to the gravity load-carrying connections provided by vertical shear tabs 26 between the webs of the beams and the column, and discussed in connection with and shown in FIGS. 4., 6, 8 and other Figs.

Figure 19:
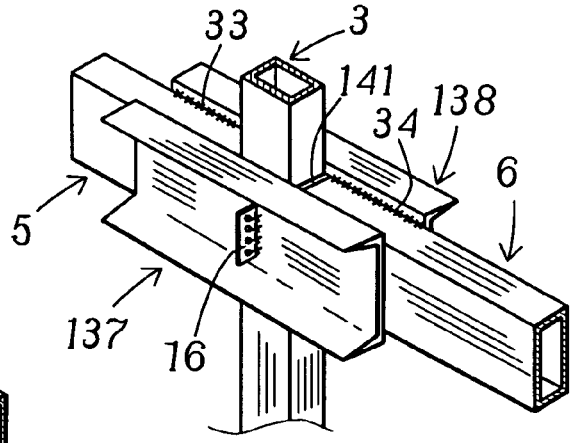
FIG. 19 illustrates another embodiment of the invention in which the gusset plates are in the form of channels fillet welded to box beams, as in FIG. 18, which channel gusset plates provide additional strength, particularly in resistance to moment, or bending, forces.

FIG. 19 illustrates another embodiment of the invention in which the gusset plates are in the form of channels 137 and 138. Channel gusset plate 138 is fillet welded to box beams 5 and 6, as in FIG. 18, by fillet welds such as 33 and 34. Channel gusset plate 137 is similarly fillet welded to box beams 5 and 6. The channel shape of gusset plates 137 and 138 provide additional strength, particularly in resistance to moment, or bending, forces. As in FIG. 18, vertical, full-penetration, single bevel groove welds between the sides of the box beams 5 and 6 and box column 3 may be used to provide gravity load-carrying connections between the beams 5 and 6 and column 3.

Vertical shear tab 16, which is filled welded to gusset plate 137, illustrates one way in which an orthogonal beam might be connected to the joint, by fasteners, that is, bolts or rivets. Of course, the vertical shear tab may also be welded, by fillet weld or other suitable weld, to the orthogonal beam, rather than bolted or riveted.

Figure 20:
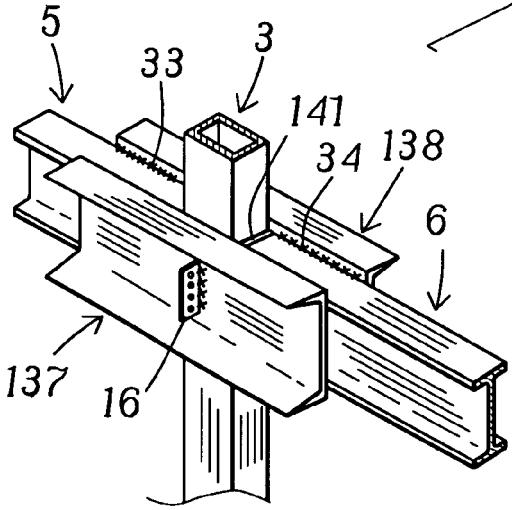
FIG. 20 illustrates the invention with the gusset plates in the form of channels fillet welded to an "H" beam whose flanges are welded to the box column by full penetration, single bevel groove welds.

FIG. 20 illustrates the invention with the gusset plates 137 and 138 in the form of channels. Gusset plate 138 is shown fillet welded by fillet welds 33 and 34, to the longitudinal edges of the top flanges of "H" beams 5 and 6, the ends of whose top and bottom flanges are all welded to the box column 3 by full penetration, single bevel groove welds, such as weld 141. Gusset plate 137 is similarly fillet welded to "H" beams 5 and 6. It should be noted that beams 5 and 6 would each have a vertical shear tab attached thereto (by welding, bolting or riveting), which, in turn, would be preferably fillet welded to a flange of column 3 as taught hereinbefore. These vertical shear tabs would provide the important gravity load-carrying connection between the beams and the column. Of course, suitable, alternative gravity load-carrying connections between the beams and the column might also be used.

Figure 21:
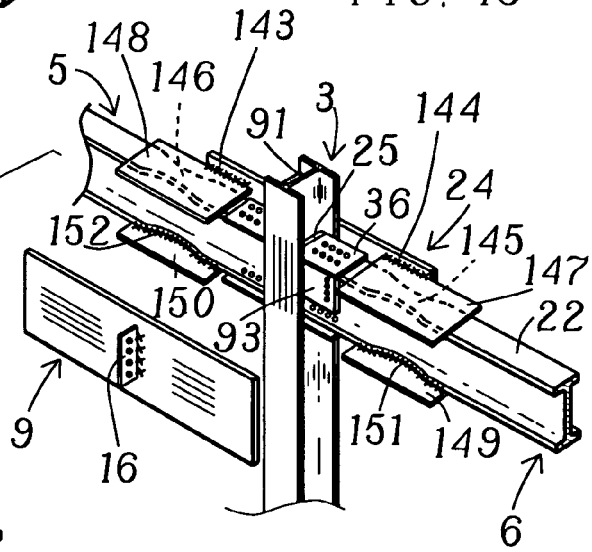
FIG. 21 illustrates the invention with cover plates welded to the web of a column and bolted to the flanges of "dogbone" beams. Vertical shear tabs connect the webs of the beams to the web of the column. The gusset plates are fillet welded to additional cover plates which are fillet welded to the flanges of the "dogbone" beams. It is noted that the additional cover plates cover the narrowed portion of the "dogbone" beams. The near gusset plate is exploded away for clarity.

FIG. 21 illustrates the invention with the near gusset plate 9 exploded away for clarity. A cover plate, such as top cover plate 36, is fastened to each of the four flanges of beams 5 and 6, making four cover plates in all. Each of the fastened four cover plates are welded to the web 91 of column 3 in a full penetration, single bevel groove weld, providing a substantial moment-resisting connection between column 3 and beams 5 and 6. In addition, cover plates 147–150 are welded over the narrowed flanges 145 and 146 of "dogbone" beams 5 and 6. Bottom flanges 149 and 150 may be seen to be fillet welded to the bottom flanges of beams 5 and 6, by fillet welds 151 and 152. Corresponding fillet welds, (not visible), weld the bottom cover plates 149 and 150 to the other, (hidden), side of beams 5 and 6. The top cover plates 147 and 148 are similarly fillet welded to the top flanges of beams 5 and 6.

Vertical shear tabs, such as vertical shear tab 93, connect the webs of the beams 5 and 6 to the web 91 of the column 3, to provide a substantial gravity load-carrying connection.

The gusset plates 9 and 24 are fillet welded to cover plates 147–150 by fillet welds such as fillet welds 143 and 144.

Figure 22:
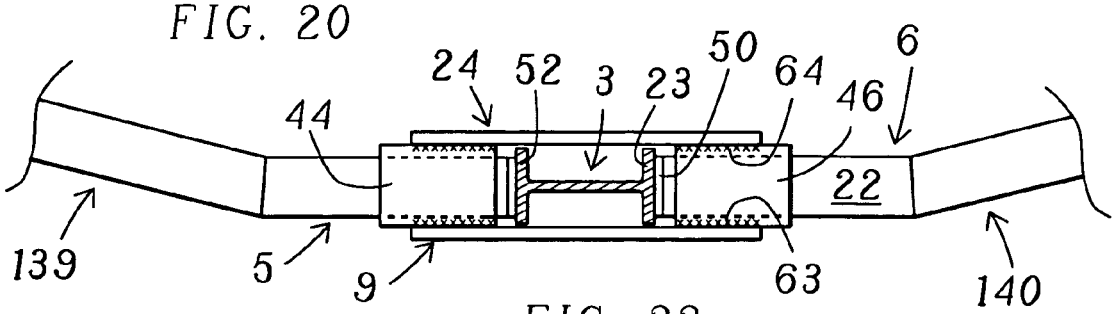
FIG. 22 illustrates in simplistic form, the invention used in curved structures, wherein the beams of the structure are at a substantial angle with respect to each other. The first segment of each beam is connected to the flange of the column by a full penetration, single bevel groove weld Cover plates are fillet welded to the top and bottom flanges of the first segment of each beam. The top cover plates, for example, are welded on their underside, (thus, such fillet welds are not visible), to such first segment of each beam and, also, are fillet welded on top sides to the gusset plates. Such fillet welds all run in the longitudinal direction of the beam.

FIG. 22 illustrates in simplistic form, the invention used in curved structures, wherein link beams 139 and 140, are spliced, (by welding, bolting or riveting, in accordance with accepted practice), to beams 5 and 6 of the beam-to-column joint structure. The link beams 139 and 140 are at a substantial angle with respect to each other and with respect to beams 5 and 6 The end of top flange 22 of beam 6 is connected to flange 23 of column 3 by full penetration, single bevel groove weld 50. The end of the bottom flange (not shown) of beam 6 is similarly welded to flange 23 of column 3. The ends of the top and bottom flanges of beam 5 are similarly welded by full penetration, single bevel groove welds to flange 52 of column 3. Connection of the flanges of beams 5 and 6 to column 3, in such fashion, provides a strong, moment-resisting beam-to-column joint connection. Top cover plates 44 and 46 are fillet welded on their underside, (such fillet welds are not visible), to beams 5 and 6, respectively. Top cover plate 46 is shown attached on its top side to the gusset plates 9 and 24 by fillet welds 63 and 64. Top cover plate 44 is similarly fillet welded to gusset plates 9 and 24. Beams 5 and 6 also have bottom cover plates (not visible) corresponding to the top cover plates 44 and 46. Such bottom cover plates are each similarly fillet welded to their respective beam and to gusset plates 9 and 24. All fillet welds run in the longitudinal direction of the beams 5 and 6.

Although specific embodiments and structural arrangements have been illustrated and described herein, it will be clear to those skilled in the art that various other modifications and embodiments may be made incorporating the spirit and scope of the underlying inventive concepts and that the same are not limited to the particular forms herein shown and described, except as determined by the scope of the following claims.

I claim:

1. A structural joint connection comprising:

a column capable of providing permanent, columnar support of a structure such as a building, tower and similarly heavy structure;

two beams disposed on opposite sides of said column with respect to each other and wherein said beams extend in generally opposite directions away from said column;

wherein said two beams are each attached with respect to said column, in a gravity load-carrying connection, by which said column provides support for said beams and the gravity loads on said beams;

wherein each said beam is also connected to said column in a moment-resisting connection, which resists vertical moments substantially equal to the ultimate vertical moment capacity of each of said beams;

wherein said gravity load-carrying connection and said moment-resisting connection comprise a beam-to-column joint connection having sufficient strength to develop axial tension substantially equal to the tensile capacity of said beam;

two gusset plates disposed face-to-face with respect to each other, on opposite sides of said beams and said column, at the location said two beams are attached with respect to said column;

wherein said gusset plates extend along opposite sides of both of said beams;

wherein each said gusset plate is fixedly attached, with respect to each said beam, by an axial tension and moment-resisting connection to each of said beams, resulting in an axial tension and moment-resisting connection between said beams, through said gusset plates, which axial tension and moment-resisting connection between said beams resists axial tension substantially equal to the ultimate tensile capacity of the beams, upon loss of support from said column, and, simultaneously, resists vertical moments about the major axis of each said beam substantially equal to the vertical moment capacity of each said beam upon loss of support from said column, and wherein said gusset plates are not welded directly to said column, by vertical welds along said column, to provide a moment-resisting, beam-to-column joint connection, nor attached directly to said column by angle irons nor bolts or rivets, to provide a moment-resisting or shear type beam-to-column joint connection.

2. The joint connection recited in claim 1, wherein, said axial tension and moment connection between said beams is comprised of longitudinal welds along said gusset plates, in the longitudinal direction of said beams.

3. The joint connection recited in claim 2, wherein, each of said beams has two flanges;

said column has two flanges; and each of said moment-resisting connections of said beams to said column comprises said two flanges of each said beam welded directly to one of said flanges of said column.

4. The joint connection recited in claim 2, wherein, each of said beams has two flanges;

is included a plurality of cover plates;

at least one cover plate is attached to each said flange of each said beam;

said column has two flanges; and each of said moment-resisting connections of said beams to said column comprises at least one of said plurality of cover plates fixedly attached to one of said flanges of said column.

5. The joint connection recited in claim 2, wherein, each of said beams has a top and a bottom flange; and said longitudinal welds are between said gusset plates and said flanges.

6. The joint connection recited in claim 2, wherein, each of said two beams has a top and bottom flange;

is included four, separate, cover plate means, each attached to a respective one of said flanges; and said longitudinal welds are between said gusset plates and each of said four, separate, cover plate means.

7. The joint connection recited in claim 6, wherein, each said separate, cover plate means comprises a single cover plate; and said longitudinal welds are between said gusset plates and said single cover plates.

8. The joint connection recited in claim 6, wherein, each said separate, cover plate means comprises two cover plates, and said longitudinal welds are between each of said gusset plates and one cover plate of each said separate, cover plate means.

9. The joint connection recited in claim 2, wherein,
each said beam has a top flange and a bottom flange;
is included a plurality of cover plate means, each attached to a respective one of said flanges;
each of said cover plate means comprises angle irons; and
said longitudinal welds are between said gusset plates and said angle irons.

10. The joint connection recited in claim 2, wherein,
said gusset plates are structure that can be welded or fastened to other structure and having strength equivalent to structural steel plate.

11. The joint connection recited in claim 2, wherein,
said beams each have a top flange and a bottom flange;
is included four "U" channels;
one of said "U" channels is attached to each of said flanges; and
said longitudinal welds are between said gusset plates and said "U"channels.

12. The joint connection recited in claim 2, wherein is included,
a first pair of vertical shear plates disposed oppositely from each other on opposite sides of one of said beams and welded to said one beam;
a second pair of vertical shear plates disposed oppositely from each other on opposites sides of the other of said beams and welded to said other beam; and
wherein said axial tension and moment connection between said gusset plates and said beams is comprised of one of said gusset plates welded to two of said vertical shear plates, one on each of said beams, on one side of each of said beams, and the other of said gusset plates welded to the other two of said vertical shear plates, one on each of said beams, on the other side of each of said beams.

13. A disaster-resistant, beam-to-beam, structural joint connection, comprising,
a column having sufficient strength to provide support for a structure such as a building, tower or similarly heavy structure;
first and second beams disposed on opposite sides of said column;
wherein each of said beams has one end thereof attached with respect to said column in a beam-to-column joint connection capable of transferring the gravity load on said beam to said column and having sufficient strength to develop axial tension substantially equal to the ultimate tensile capacity of said beam;
wherein each said beam-to-column joint connection is also comprised of a moment-resisting connection between said beam and said column;
wherein said moment-resisting connections are capable of resisting vertical moment loads on said beams, substantially equal to the ultimate vertical moment capacity of said beams;
wherein the other end of each of said beams is disposed away from said column;
wherein is included beam-to-beam connection means connecting said one end of each of said beams together;
wherein said beam-to-beam connection means extends around both sides of said column without being welded directly to said column by vertical welds alone said column, to provide a moment-resisting, beam-to-column joint connection, nor attached directly to said column by angle irons nor bolts or rivets, to provide a moment-resisting or shear type beam-to-column joint connection;
wherein said beam-to-beam connection means extend along opposite sides of both of said beams; and
wherein said beam-to-beam connection means has sufficient strength to resist severe axial tension and moment loads on said beams, such as axial tension and moment loads caused by a "double-span" condition created by the loss of the support of said column, upon blasts, explosions, earthquakes, tornadoes and other disastrous events.

14. The joint connection of claim 13, wherein,
said beam-to-beam connection means comprises two gusset plates disposed on opposite sides of said column and said beams;
said gusset plates are face to face with respect to each other;
said beam-to-beam connection means is comprised of said gusset plates fixedly attached with respect to both said beams; and
said beam-to-beam connection means has a strength substantially equal to the strength necessary to develop the ultimate tensile capacity of said beams and to develop a substantial part of or substantially all of the torsional and flexural capacity of said beams.

15. The joint connection of claim 14 wherein, said gusset plates are fixedly attached with respect to both said beams by longitudinal welds extending in the direction of said beams.

16. The joint connection of claim 15 wherein said beam-to-beam connection means comprises vertical shear plates welded between said gusset plates and said beams.

17. A structural joint connection comprising
a column capable of providing permanent support for a building, tower and similarly heavy, structures;
two beams similarly attached in a gravity load-carrying connection with respect to said column, on opposing sides of said column whereby said column provides support for said two beams and the gravity loads on said beams;
wherein at least one of said two beams is attached to said column in at least a vertical moment-resisting connection;
two gusset plates disposed opposite each other, on opposite sides of said beams and said column;
wherein said gusset plates extend along opposite sides of both of said beams;
wherein said gusset plates are not welded directly to said column by vertical welds alone said column, to provide a moment-resisting, beam-to-column joint connection, nor attached directly to said column by angle irons nor bolts or rivets, to provide a moment-resisting or shear type beam-to-column joint connection;
wherein is included beam-to-beam connection means comprising each said gusset plate fixedly attached with respect to both said beams in an axial tension and moment-resisting connection having a strength substantially equal to the strength necessary to develop the ultimate tensile capacity and the ultimate flexural capacity of said beams.

18. The structural joint connection of claim 17, wherein,
both of said two beams are each connected to said column in at least a vertical moment-resisting connection;
said gravity load-carrying connections are sufficiently strong to enable said beams to continue to carry their gravity loads and any additional gravity and axial tensile loads placed upon them by the "double-span-"condition created upon the loss of support by said column.

19. The structural joint connection of claim 18, wherein, said axial tension and moment-resisting connection comprises longitudinal welds along said gusset plates in the longitudinal direction of said beams;

wherein said beam-to-beam connection means comprises vertical shear plates welded between said gusset plates and said beams.

20. The structural joint connection of claim 19, wherein, said beams have top and bottom flanges; and;

said axial tension and moment resisting connection comprises longitudinal welds between said gusset plates and said flanges of said beams.

21. The structural joint connection of claim 19, wherein, each said beam has a top and bottom flange;

said tension and moment connection is comprised of four cover plate means;

each of said four cover plate means is fixedly attached with respect to a respective one of said flanges; and said longitudinal welds are between said gusset plates and said cover plate means.

22. The structural joint connection of claim 17 wherein, is included continuity plates between each said gusset plate and said column;

wherein said continuity plates are welded directly to said column and said gusset plates by horizontal welds, to enhance the transfer of axial tension in each of said beams to said column, upon said column being adjacent to a compromised column or said column being adjacent to a column having a compromised beams-to-column joint connection.

* * * * *